United States Patent [19]

Sessions

[11] 4,043,302

[45] Aug. 23, 1977

[54] SOLID STATE IGNITION SYSTEM AND METHOD FOR LINEARLY REGULATING THE DWELL TIME THEREOF

[75] Inventor: Douglas Charles Sessions, Phoenix, Ariz.

[73] Assignee: Motorola, Inc., Schaumburg, Ill.

[21] Appl. No.: 642,504

[22] Filed: Dec. 19, 1975

Related U.S. Application Data

[63] Continuation-in-part of Ser. No. 607,402, Aug. 25, 1975.

[51] Int. Cl.[2] ..... F02P 1/00

[52] U.S. Cl. ..... 123/117 R; 123/148 E

[58] Field of Search ..... 123/117 R, 117 D, 146.5 A, 123/148 E

[56] References Cited

U.S. PATENT DOCUMENTS

| | | | |
|---|---|---|---|
| 3,867,916 | 2/1975 | Bigalke | 123/117 R |
| 3,885,534 | 5/1975 | Webster | 123/117 R |
| 3,888,220 | 6/1975 | Bigalke et al. | 123/117 R |
| 3,890,944 | 6/1975 | Werner et al. | 123/146.5 A |
| 3,916,855 | 11/1975 | Fauser et al. | 123/148 E |
| 3,923,030 | 12/1975 | Luteran | 123/148 E |
| 3,938,490 | 2/1976 | Snyder et al. | 123/148 E |
| 3,943,896 | 3/1976 | Green et al. | 123/148 E |
| 3,976,043 | 8/1976 | Camp et al. | 123/117 R |
| 3,989,024 | 11/1976 | Lai et al. | 123/148 E |

FOREIGN PATENT DOCUMENTS

| | | | |
|---|---|---|---|
| 2,456,580 | 6/1975 | Germany | 123/148 E |
| 2,505,649 | 9/1975 | Germany | 123/148 E |
| 2,524,043 | 12/1975 | Germany | 123/148 E |

*Primary Examiner*—Carroll B. Dority, Jr.
*Assistant Examiner*—Paul Devinsky
*Attorney, Agent, or Firm*—Michael D. Bingham

[57] ABSTRACT

An electronic, solid-state ignition system for an internal combustion engine is disclosed which is responsive to alternating timing signals produced in timed relationship with the engine. The electronic system comprises a plurality of integrator circuits, as transistorized output stage and a feedback loop for linearly regulating the current limit duty cycle to a fixed percentage of the firing cycle time period independent of current ramp time through the coil. A further circuit also responsive to the timing signals is included, which circuit overrides the aforementioned electronic system below a predetermined engine rpm. The overriding circuit effects a desired lead angle to the timing signals applied thereto to produce a minimum dwell angle for engine speeds below the predetermined engine rpm. As a result, sufficient spark potential is developed and predetermined spark timing is produced, with minimum power consumption in the ignition system, thereby preventing misspark even though the engine may be accelerating at a maximum specified rate or decelerating.

18 Claims, 6 Drawing Figures

SOLID STATE IGNITION SYSTEM AND METHOD FOR LINEARLY REGULATING THE DWELL TIME THEREOF

BACKGROUND OF THE INVENTION

The application is a continuation-in-part of application Ser. No. 607,402 filed Aug. 25, 1975.

This invention relates to internal combustion engine ignition systems and, more particularly, to a solid-state ignition system.

Internal combustion engines which are to be used in "tomorrows" automobiles may be required to operate for an equivalent of 50,000 miles without nay significant increase in pollutant emission. It has been recognized that present mechanical ignition systems are inadequate with respect to this requirement and that electronic ignition systems which are completely solid-state are needed. Several forms of solid-state ignition systems have been constructed to replace the conventional mechanical breaker point type of ignition systems now being used. These prior art solid-state ignition systems are mostly concerned with providing adequate sparking potential to operate the internal combustion engine and limiting the energization current produced thereby in order to protect transistorized output stages and the ignition coil.

Furthermore, because many automobiles today employ catalytic converters for reducing pollution emissions, it is important that sufficient spark potential be developed to prevent a no-spark condition from occurring during operation of the engine. If during either constant engine RPM operation or during engine acceleration, a sprak does not occur in timed relationship to the engine cycle, raw fuel could be drawn directly into the catalytic converter. Since catalytic converters have high internal temperatures, the raw fuel could be ignited therein which might damage the converter. Therefore, it is of major concern that solid state ignition systems provide sufficient energization current to the primary winding of the ignition coil in correct timed relationship to the operation of the engine to ensure that a spark will be produced to prevent damage to the catalytic converter.

Other systems have excessive dwell times at lower engine speeds, which dwell times may approach 75% of the entire firing cycle. This is an undesirous condition as greater battery drain occurs. Moreover, longer dwell times produce longer periods of high power consumption in the semiconductor devices of devices of the output circuitry of these ignition systems. Therefore, larger and more expensive devices are required.

Thus a need exists for a solid-state ignition system which provides a fixed current-limit duty cycle of the energizing current with respect to the total time period of the firing cycle of the internal combustion engine. A further need exists for an ignition system suitable for reducing excess dwell times at lower engine speeds.

SUMMARY OF THE INVENTION

Accordingly, it is an object of the present invention to provide an improved solid-state ignition system for internal combustion engines.

It is another object of the invention to provide a solid-state ignition system which limits the magnitude of energization current flow through the ignition coil to a predetermined value and which provides sufficient spark potential to ensure firing in the engine.

It is still another object of the invention to provide a solid-state ignition system including a linear feedback control loop for regulating the energization current-limiting duty cycle to a substantially fixed percentage of the total time period of the firing cycle of the internal combustion engine.

It is a further object of the invention to provide a solid-state ignition system including a linear feedback control loop for regulating the energization current-limiting duty cycle to a substantially fixed percent of the time period of the firing cycle of the internal combustion engine even though the current charge time through the ignition coil varies.

It is a still further object of the invention to provide an ignition system including a phase shifting network for regulating excess dwell time to be a substantially fixed percentage of the firing cycle time period above a predetermined engine upon and for producing minimum dwell angles when the engine is operating below the predetermined rpm.

In accordance with the present invention, a solid-state ignition system and method for regulating the output current-limit duty cycle to a fixed percent of the total time period of the firing cycle of an internal combustion engine are provided wherein enough energization current is provided through an ignition coil primary winding to generate sufficient spark potential. Moreover, the solid-state ignition system employs a linear feedback control loop responsive to generated timing signals crossing a zero reference point for linearly varying a threshold control voltage to either increase or decrease energization current-limiting time through the primary winding of the ignition coil. This maintains the aforementioned current-limit duty cycle to a predetermined, substantially fixed percent of the engine firing cycle time period regardless of variation in the charging ramp time of the energization current through the ignition coil.

The solid-state ignition system including an output amplifier stage is rendered conductive and nonconductive in timed relationship to successive generated timing signals for charging and discharging the ignition coil. The output amplifier stage is rendered conductive in response to an applied control signal. A first circuit is provided for producing a reference signal having first and second portions indicative, respectively, of a first time interval of the ignition signals and the remainder of the duration of the ignition signals. A second circuit is operatively coupled to the first circuit for producing a threshold signal. The reference signal and threshold signal are compared by a comparator gating circuit which produces the control signal to render the output amplifier stage conductive when the magnitude of the second portion of the reference signal reaches a predetermined value with respect to the magnitude of the threshold signal. A feedback circuit is operatively coupled to the output amplifier stage and produces a feedback signal for limiting the current through the output amplifier stage and for linearly varying the magnitude of the threshold signal in relation to the time duration of each successive, applied ignition signal so that the current-limit duty cycle remains a constant percent of the firing cycle time period. Thus sufficient sparking potential is provided even though the engine may be accelerating at a maximum specified rate.

According to another feature of the invention a phase shifting network is utilized to provide a control signal which causes charging and discharging of the ignition coil at engine speeds below a predetermined rpm. A disabling circuit inhibits any output from the comparator-gating circuit at lower engine speeds such that the control signal from the phase shifting network controls the dwell angle. Thus, minimum dwell angles are established below the predetermined engine speed which the aforedescribed linear feedback system may increase but not decrease.

DETAILED DESCRIPTION OF THE PREFERRED EMBODIMENTS

Figure 1:
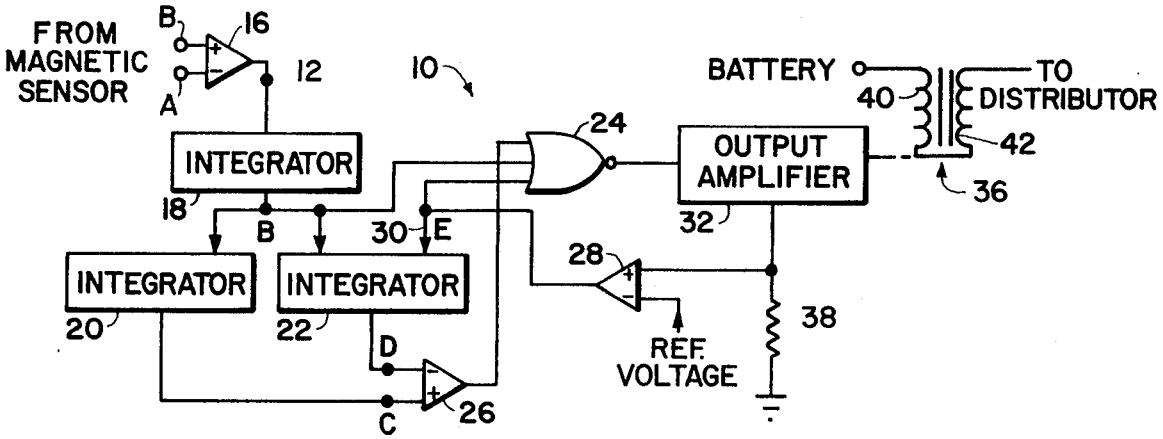
FIG. 1 is a partial block and schematic diagram illustrating a solid-state ignition system of one embodiment of the invention.

Referring to FIG. 1, there is illustrated in block diagram form solid-state ignition system 10 which is to be included in an internal combustion engine. Timing signals having generally a sinusoidal shape (waveform A of FIG. 2), with positive and negative portions, are produced in timed relationship with the engine in a well known manner. These timing signals are differentially applied to input terminals A and B, respectively, of differential comparator 16. The output of comparator 16 is applied to integrator circuit 18 the output of which is coupled to the inputs of integrator 20, integrator 22, and one input of NOR gate 24. The respective outputs of integrators 20 and 22 are applied to the input of comparator 26 which, as will be explained hereinafter, provides a control signal at the output thereof when the magnitude of the output signal from integrator 20 is of a predetermined relationship with the output of integrator 22. The output of comparator 26 is connected to a second input of NOR gate 24. A third input to NOR gate 24 is provided from the output of comparator 28 which is also coupled to an input of integrator 22 through conductor 30. The output of NOR gate 24 is coupled to an output amplifier transistor stage 32 which is serially connected between ignition coil 36 and current sensing resistor 38 the other terminal of which is connected to a ground reference terminal. A conventional storage battery (not shown) is coupled in a known manner to one terminal of primary winding 40 of ignition coil 36 with the other terminal of the primary winding being coupled to the output of amplifier stage 32. The secondary winding 42 of ignition coil 36 is coupled to the distributor of the internal combustion engine, as is well known in the art, for providing spark potential to the spark plugs of the internal combustion engine in timed relationship with the cycling of the engine.

In general, integrator circuits 18, 20 and 22 shown in block diagram form in FIG. 1 comprise an integrating capacitor (not shown), and solid-state circuitry suitable for charging and discharging the integrating capacitor at particular ramp rates to provide output signals of a predetermined wave shape as will be hereinafter described. Therefore, because many different integrating circuits may be used by those skilled in the art, the aforementioned integrator circuits will not be specifically described.

For illustration purposes, it is assumed that the internal combustion engine is operating in a steady-state condition or at a constant RPM so that the period of the engine firing cycle is constant. Thus, the generally sinusoidal timing signals produced in timed relationship with the engine will have a constant time period illustrated as time, $T_0$–T5 in FIG. 2. This cycle is not a complete cycle of the rotor of the distributor but represents the cycle required to produce each individual spark in the firing sequence of the operation of the engine. In response to each timing signal (FIG. 2A), differentiator-comparator 16 produces square wave pulse trains 50 (FIG. 2B) having a substantially 50 percent duty cycle. Waveform portions 52 and 54 are generated during the positive and negative half cycles, respectively, of each applied timing signal.

In response to the square wave pulse train being applied to input terminal 12 of integrator circuit 18, an integrating capacitor (not shown) is discharged at a first controlled rate from an established voltage level, which is dependent on the previous firing cycle period, during the first quarter period $T_0$–$T_1$. The capacitor is then charged at a second controlled rate between time $T_2$–$T_5$. Integrator circuit 18, for example, may include a comparator and gating circuit whereby an output pulse is produced only while the afore-mentioned integrating capacitor is being discharged so that a monopulse signal (FIG. 2C) is developed at an output terminal. By establishing the rates at which the capacitor is charged and discharged, to be of the correct ratio to one another, pulse 58 can be caused to occur during the first quarter cycle of the time period for each generated ignition signal.

The output of integrator circuit 18 is applied to one input of NOR gate 24 and positively inhibits any output therefrom during time period $T_0$–$T_1$ such that output amplifier stage 32 is prevented from being rendered conductive. Therefore, energizing current cannot be produced through primary winding 40 during the first quarter portion of the firing cycle. This is to ensure that any noise signal produced at the end of the previous firing period does not energize the ignition coil. Simultaneously, the output pulse of integrator 18 is applied to the inputs of integrator circuits 20 and 22.

Integrator circuit 20, which includes an integrating capacitor, produces a reference signal at the output thereof in response to the application of the output from integrator 18. It is to be understood, that during time interval $T_0$–$T_1$ with the application of pulse 58, the aforementioned capacitor is caused to be charged at a first predetermined rate such that output portion 62 of waveform 64 (FIG. 2D) ramps upward. During the remainder of the firing cycle ($T_1$–$T_5$) the capacitor is discharged at a different rate such that the output ramps downward, portion 64. In a manner well known in the art, if the capacitor is charged during the first quarter of the firing cycle at three times the rate that it is discharged, and if the slope of portion 64 of waveform 60 is equal to $-1$, the output pulse produced during each firing cycle will be initiated from ground potential and will reach a predetermined magnitude at time $T_1$. The final value of the magnitude of the reference pulse will therefore be at ground potential at the end of the firing cycle, time $T_5$.

Referring to waveform 68, (FIG. 2E) integrator circuit 22 produces a variable threshold voltage at the output thereof. In the steady-state condition, the magnitude of the threshold voltage is held constant and is illustrated as $V_{TH1}$. In response to the applied quarter cycle pulse from integrator circuit 18, the voltage across an internal capacitor (not shown) of integrator circuit 22 ramps up to the threshold voltage from a previously established potential, $V_{Ref}$, until time $T_1$. The potential illustrated as $V_{ref}$ is dependent on the time period of the previous firing cycle, being constant only during a steady state condition. The output from integrator circuit 22 will remain constant at $V_{TH1}$ until time $T_4$ at which time the capacitor is discharged, as will be explained, at a different rate than it is charged and reaches the potential, $V_{ref}$, at time $T_5$.

The outputs from integrator circuits 20 and 22 are compared by comparator 26. When the magnitude of the output pulse from integrator circuit 20 is greater than the threshold potential appearing at the output of integrator circuit 22, the output from comparator 26 is a logic "1" such that NOR gate 24 inhibits output amplifier 32 from being rendered conductive. Thus, between the time interval $T_0$ to $T_3$, no energizing current is produced. However, at time $T_3$, when the magnitude of the output from integrator circuit 20 becomes substantially equal to or less than the magnitude of the threshold potential from integrator circuit 22, the output of comparator 26 changes sense. Therefore, all of the inputs to NOR gate 24 are at a logic "0", and NOR gate 24 is enabled to thereby render output amplifier 32 conductive. In response thereto, energization current begins to flow through primary winding 40 (portion 69 of waveform 70, FIG. 2F) through the amplifier and sensing resistor 38 to ground. The output pulse from integrator 20 is caused to be returned to ground potential (waveform portion 72) such that integrator circuit 20 is returned to its initial state. This assures that at the beginning of the next firing cycle, time $T_5$, the output from this integrator will rise from ground potential.

Between time $T_3$–$T_4$, with amplifier stage 32 being in a saturated condition, the energizing current produced therethrough rises at a rate most nearly determined by the L/R time constant of primary winding 40, portion 69 of waveform 70. In response to the magnitude of the energizing current through primary winding reaching a predetermined value, the current feedback loop comprising sensing resistor 38 and comparator 28 is rendered operative to produce an increasing inhibiting signal to NOR gate 24. As NOR gate 24 is inhibited, the drive signal to amplifier stage 32 is reduced such that current limiting is reached at time $T_4$ and no further increase in energizing current occurs between time $T_4$–$T_5$ as illustrated by portion 74 of waveform 70. Simultaneously, the output signal from comparator 28 is applied to the other input to integrator circuit 22 such that the output thereof is reduced at the same rate as portion 64 of the output pulse waveform 60 of integrator circuit 20 (portion 76 of waveform 68). At time $T_5$, the beginning of the next firing time period, in response to the next timing signal being applied to the input of comparator 16, another 25 percent duty cycle pulse will be generated by integrator circuit 18. NOR gate 24 is then positively inhibited and amplifier stage 32 is rendered nonconductive. Subsequently, energization current through ignition coil 36 is abruptly ceased (portion 78 of waveform 70) and the magnetic field collapses thereacross which produces a spark potential across secondary winding 42 and ignition in the engine, as is understood.

In a steady state condition, i.e., the engine is running at constant speed, each cylinder will be ignited in timed relationship to the engine. Moreover, by selecting the rate of increase of portion 66 of the threshold voltage output pulse from integrator circuit 22 to be of a predetermined ratio to the rate of decrease of portion 76, the current-limit duty cycle (portion 74) will be a fixed percentage of the total firing cycle, time interval $T_0$–$T_5$. For example, if the slope of waveform 68 between time $T_0$–$T_1$ (25 percent of the time period $T_0$–$T_5$) is caused to be constant, and is four tenths of the value of the slope between time $T_4$–$T_5$, the current-limiting duty cycle is regulated to be substantially a fixed 10 percent of the total firing cycle. Therefore, sufficient spark potential will be developed at time $T_5$ to cause ignition in the engine. Simultaneously to the collapse of the field across primary winding 40 and the beginning of the next applied timing signal, the afore-described output pulses are again initiated by the solid-state ignition system 10.

Thus, what has been described above, is an electronic circuit for a solid-state ignition system for providing sufficient spark potential in timed relationship to the engine. It was assumed that the engine was running at a constant speed such that the magnitude of the threshold voltage produced at the output of integrator circuit 22 would reach a constant value between each firing cycle. In response to the comparison of the relative magnitudes of the threshold voltage and a reference signal pulse, energization current is generated at a predetermined time during the firing cycle such that a constant dwell time (energizing current on time to off time) is provided to ensure sufficient spark potential to be present. The current limit duty cycle is caused to be constant at any engine RPM, as long as the engine RPM is constant.

However, during conditions other than steady-state, i.e., when the engine is accelerating, it is important to ensure adequate spark potential be maintained. If a specified current-limiting time period can be obtained prior to initiation of an ignition spark, sufficient spark potential will be obtained for the internal combustion engine for a specified acceleration rate.

Figure 2:
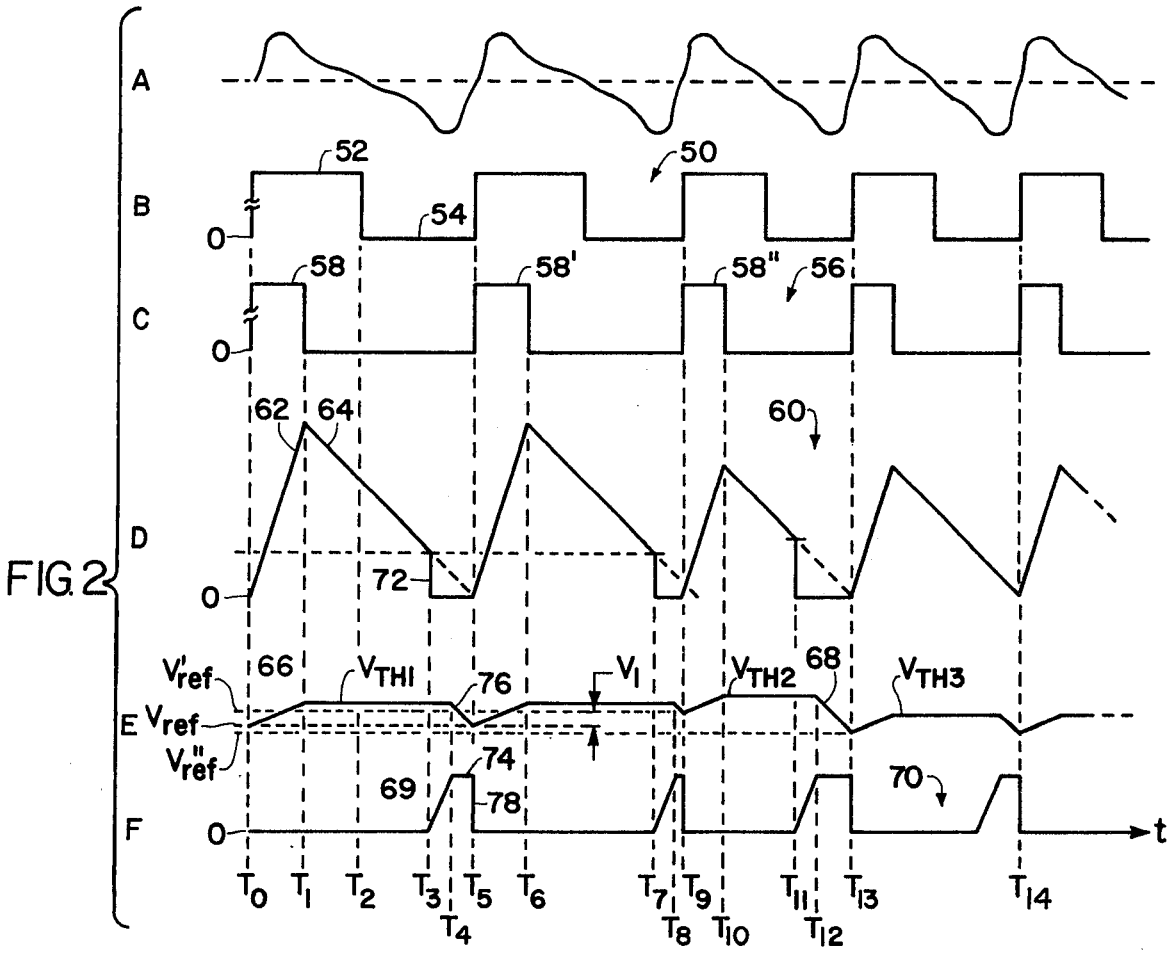
FIG. 2 illustrates waveforms which are useful in understanding the operation of the embodiment of the invention.

Still referring to FIG. 2, for illustration purposes, it is assumed that the engine speed is accelerating during time interval $T_5$–$T_9$ and reaches a new steady-state condition thereafter. Therefore, in response to initiation of the quarter cycle pulse at time $T_5$, the output pulse from integrator circuit 20 ramps up at a constant slope of three (as previously discussed), until time $T_6$, when the pulse begins ramping downward with a constant slope of one, due to the termination of quarter cycle pulse 58'. Simultaneously, the output pulse from integrator circuit 22 is charging to the same magnitude of threshold voltage, $V_{TH1}$ of the previous cycle. At time $T_7$, the magnitude of the pulse from integrator circuit 20 becomes equal to the threshold voltage and energizing current is initiated as previously explained. Current-limiting occurs at time, $T_8$, and the output pulse from integrator 22 once more begins to discharge with the slope of $-1$. Because the engine speed is accelerating, the firing cycle time period, $T_5$–$T_9$ is foreshortened such that the output pulse from integrator circuit 22 is not fully discharged to the initial voltage, $V_{ref}$, when the next quarter cycle pulse 58'' is applied, the difference being illustrated as the voltage $V_1$. Therefore at time, $T_9$, the output pulse from integrator circuit 22 begins ramping upwards from the potential, $V'_{ref}$. The output of integrator circuit 22 will increase at the same constant rate until time $T_{10}$, to a higher threshold voltage level, $V_{TH2}$. With the threshold voltage being at a greater magnitude, threshold will occur sooner in the next firing cycle, at time $T_{11}$, initiating energizing current through the primary winding of the ignition coil. Current-limiting occurs at time $T_{12}$ which initiates discharging of the output voltage from integrator circuit 22 in the normal manner. As the energizing current has been initiated sooner in the firing cycle, current-limiting will occur longer which, therefore, allows the output of integrator circuit 22 to discharge to a lower voltage potential, illustrated as $V''_{ref}$. Thus, during the time interval $T_9$–$T_{13}$, although a new steady-state condition has been reached, the dwell time will be greater. However, in response to the next application of the quarter cycle pulse the output from integrator circuit 22 is charged up to the threshold potential $V_{TH3}$ and the aforedescribed cycle is repeated between times $T_{13}$ and $T_{17}$. Thereafter, as long as the engine speed remains constant at the new steady-state condition, the magnitude of the threshold voltage in subsequent firing cycles will be $V_{TH3}$. Thus, the current limit duty period is once again a constant and is substantially 10 percent of the total firing cycle.

It can be shown that the magnitude of the variable threshold signal is linearly related to the total firing cycle period and to the current charge time through the primary winding of the ignition coil. Therefore, as described above the feedback loop to integrator circuit 22 linearly varies the magnitude of the threshold voltage at the output of the integrator circuit such that the current-limit duty cycle of the ignition coil is a fixed percent of the firing cycle. Thus, with the current-limit time being fixed, sufficient spark potential is developed across the ignition coil to ensure that a spark will occur to operate the engine for a specified acceleration rate of the engine RPM. Moreover, by controlling the rates of charge and discharge of the integrating capacitor of integrator circuit 22, which in the above described circuit might be a ratio of 1:0.4, the current-limit duty cycle is approximately 10 percent of the firing cycle. Thus, even though the charge time through the coil may vary, due to different coils being used or to varying battery voltages, a value of 10 percent is sufficient to ensure a spark during maximum specified acceleration rates of engine RPM.

Figure 3:
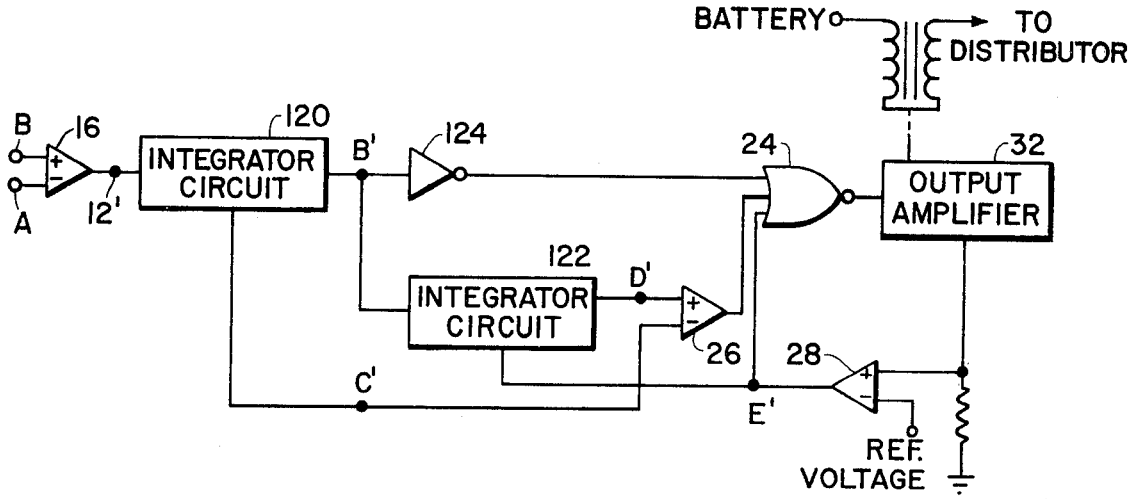
FIG. 3 is a partial block and schematic diagram illustrating a solid-state ignition system of another embodiment of the invention.
Figure 4:
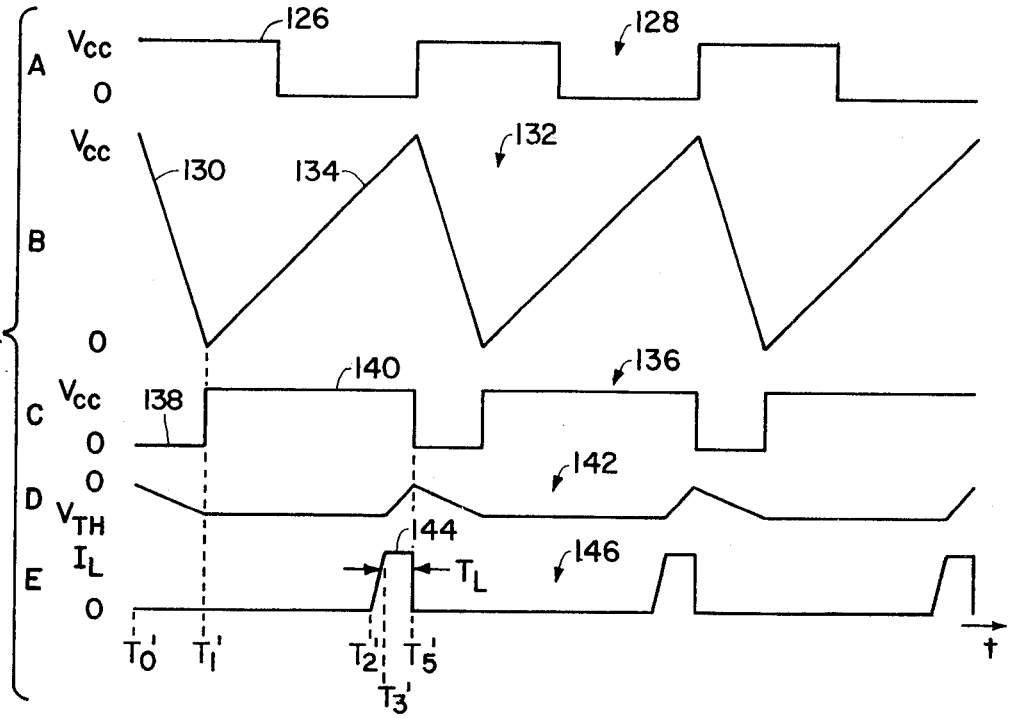
FIG. 4 illustrates waveforms useful in understanding the operation of the embodiment of FIG. 4.

Referring to FIGS. 3 and 4, the same reference numbers are used for components corresponding to like components of FIG. 1. The structure of the circuit of FIG. 3 is very similar to that of FIG. 1 except that essentially (as will be discussed hereinafter) the functions of integrator circuit 18 and 20 have been combined and are provided by integrator circuit 120.

In response to each alternating current timing signal applied to input terminals A and B of comparator 16, a 50 percent duty cycle output rectangular pulse is produced at the output thereof in a like manner as discussed above. Therefore, at time $T_0'$, on the positive transition of the applied timing signal, the output of comparator 16 which is applied to input of integrator circuit 120 at terminal A', goes positive, portion 126 of waveform 128, causing the output of integrator circuit 120 at terminal C' to decrease at a constant predetermined rate. During steady state operating conditions, the output of integrator circuit 120 at the terminal C' can be caused to reach ground potential during the first quarter cycle of the applied ignition signal such that at time $T_1'$, the voltage thereat is at zero potential. In response to portion 130 becoming zero, integrator circuit 120 is internally reset such that at time $T_1'$ the output begins rising at a different predetermined constant rate, portion 134 of waveform 132. The voltage at output terminal C' continues to rise for the remaining 75 percent of the applied pulse to the input of integrator circuit 120, between time $T_1'$ and $T_5'$. Simultaneously, at output terminal B' of integrator circuit 120, an output signal is produced thereat, waveform 136, rectangular in shape and which has a first portion 138 corresponding to the decrease of the output at C' and a second portion 140 related to the time that the output at C' is rising. Thus, integrator circuit 120 produces both a phase-locked 75 percent duty-cycle signal (waveform 136) and an output voltage (waveform 132) linearly related to time before the end of the cycle.

The output of integrator circuit 120 which is applied at terminal B' is supplied to the input of integrator circuit 122 and to inverter circuit 124. Therefore, during the first quarter cycle of the input signal, waveform portion 138 of waveform 136, NOR gate 24 is positively inhibited thereby rendering output amplifier 32 nonconductive which is identical to the system of the embodiment of FIG. 1. In response to the input signal applied thereto, integrator circuit 122 produces a variable threshold voltage at output terminal D' which decreases during the first quarter cycle to a variable voltage potential which during steady state operation, the magnitude thereof remaining constant, similar to the above described ignition system. The outputs of integrator circuit 120, at output terminal C', and integrator circuit 122, at D', are compared by comparator 26 which produces an output signal to one input of NOR gate 24 at time $T_2'$ when the magnitude of waveform portion 134 becomes greater than the magnitude of the reference voltage (waveform 142) thereby rendering output amplifier 32 conductive in the same manner as previously discussed. In response to the current conducted through primary winding 40 of ignition coil 36 through amplifier 32 and sensing resistor 38 reaching a predetermined value, the magnitude of voltage produced across sensing resistor 38 causes the output of comparator 28 to change sense such that between time intervals $T_3'$–$T_5'$ the current through output amplifier 32 is limited to a predetermined value (portion 144 of waveform 146). In response to the next positive transition of the next timing signal, at time $T_5'$, the output at terminal B' once again goes low, which is then inverted for positively inhibiting NOR gate 24 such that output amplifier 32 is abruptly rendered nonconductive causing discharge of the magnetic field across primary winding 40 of ignition coil 46, thereby generating a spark to operate the engine.

Thus, in a steady state condition, the output of amplifier 32 is current-limited for a constant percent of the total firing cycle, time interval $T_L$. Therefore, the current limit time of the ignition system is a fixed percent of the total ignition cycle.

As previously discussed in great detail, if the speed of the engine should either accelerate or decelerate, such that a deviation in current-limited time $T_L$ should occur, the magnitude of the variable threshold voltage will be linearly corrected by the correct amount, thereby returning the current-limited time to a fixed percent of the overall ignition cycle.

What has been described, therefore, are improved solid state ignition systems. The ignition system of FIGS. 1 and 3 provide for linearly varying the dwell time such that it remains a fixed percent of each ignition cycle which is produced in timed relationship with an internal combustion engine. Moreover, a linear feedback control loop is employed in each of the solid state ignition system to linearly vary the dwell time in response to varying ignition cycle time periods and varying energizing current ramp time through the ignition coil. In addition, the aforedescribed solid state ignition system ensures that sufficient spark potential will be provided in timed relationship with the engine to ensure operation thereof.

The aforedescribed ignition system works quite well above a predetermined engine rpm, for example 750 rpm, in anticipating the positive zero cross of the next ignition timing signal to produce the necessary spark potential across the ignition coil of the engine. The excess dwell time (current limiting duty cycle) of ignition system 10 is sufficient to compensate for engine acceleration up to a specified acceleration rate, for example, 4,000 rpm/second. Below 750 rpm, the excess dwell time of ignition system 10 becomes variable and is a function of the ignition firing cycle. Thus, the signal applied to the amplifier portion of ignition system 10 for charging and discharging the ignition coil is a variable width pulse as the engine speed varies below 750 rpm. The reason that this variable excess dwell time pulse occurs is that the integrator circuits of ignition system 10 are limited in their dynamic range. A typical example is at an engine rpm of 150 rpm (engine cranking speed) wherein the firing cycle period is approximately 100 msec, $T_0$–$T_5$. Range limiting, due to saturation of the integrator circuits, occurs after approximately 15 msec (time $T_4$) and amplifier 32 is rendered conductive for a total of 85 msec, $T_4$–$T_5$. Thus, current is conducted through the output amplifier section of the ignition system 10 for long periods at lower engine rpm. In ignition system 10, it is desired that the current is of a longer time duration so that at the lower engine rpm the ignition system will produce a spark potential even if the engine is accelerated at the above-mentioned acceleration rate.

Figure 5:
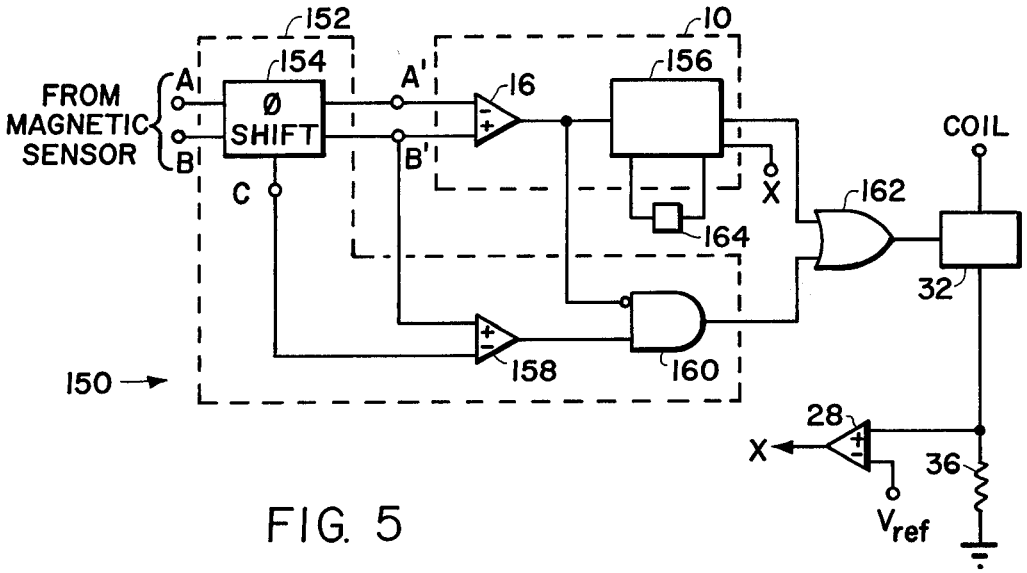
FIG. 5 is a block diagram illustrating a solid-state ignition system of yet another embodiment of the invention.

Referring to FIG. 5, there is illustrated in block diagram form another embodiment of the present invention wherein the same reference numbers are used for components corresponding to like components of FIG. 1. Ignition system 150 is illustrated as comprising ignition system 10 and phase shifting network 152.

The timing signals from the magnetic sensor are applied, as previously discussed to terminals A and B of the ignition system. The timing signals (waveform A of FIG. 2) are coupled through phase shift circuit 154 of phase shifting network 152 without any phase shifted affected thereto, to the inverting and noninverting input terminals A′ and B′ of differential comparator 16 of ignition system 10. The remaining circuits of ignition system 10, including integrator circuits 18, 20, and 22; differential comparator 26; and NOR gate 24 are illustrated in block diagram form by block 156. The linear feedback signal from comparator 28 is applied to integrator circuit 22 between terminals *x*—*x*. Ignition system 10 functions as previously discussed. The output signal from phase shift circuit 154, provided at terminals B′-C, is applied to differential comparator 158 at its noninverting and inverting input terminals respectively. The remainder of phase shifting network 152 is shown as including AND gate 160 which has an inverted signal input terminal connected to the output of comparator 14 and another input terminal connected to the output from comparator 158. The output from AND gate 160 is connected to one input terminal of OR gate 162 which has its output connected to the input of amplifier stage 32. OR gate 162 has another input terminal connected to the output of ignition system 10 (the output from NOR gate 24). Amplifier stage 32, resistor 36 and comparator 38 are connected as previously described. Disabling circuit 164, which may include a comparator and known timing circuits, is provided to temporarily inhibit ignition system 10 under certain conditions as will be discussed later.

In operation, the timing signals supplied from the magnetic sensor (waveform A, FIG. 4) are applied to terminals A—B of phase shift circuit 154 and are directly applied to terminals A′—B′, without any phase shift being effected thereto, of previously described ignition system 10. The timing signals supplied at terminals A′—B′ to differential comparator 16 are sense detected with a resulting rectangular output pulse being produced at the output of comparator 16. Ignition system 10 operates in the exact manner as previously described to produce an output signal at one input of OR gate 162. In normal operation, above a predetermined engine rpm, the input signal to OR gate 162 from ignition system 10 enables the OR gate for rendering amplifier stage 32 conductive to charge the ignition coil. In response to the next applied timing signal, ignition system 10 is disabled for the first quarter cycle such that amplifier stage 32 is rendered nonconductive whereby the ignition coil is discharged to produce the necessary spark potential to cause firing in the engine. Thus, above a predetermined engine rpm, for example, 750 rpm, firing in the engine is controlled by ignition system 10 as previously described.

The ingition timing signals are also operated on by phase shift circuit 154 such that a differential signal is produced across terminals B′—C which has a predetermined phase lead at zero-crossing effecting thereto with respect to the signal appearing across terminals B′—A′. The output of comparator 158 is substantially a square wave pulse corresponding to the signal applied to its input. Thus, the leading signal produced by phase shift circuit 154 is reduced to a variable-width pulse and is applied to AND gate 160. AND gate 160 is positively inhibited during the first half of the firing cycle due to the positive output portion of the rectangular wave from comparator 16 being inverted to the input thereof. Therefore there can be output from AND gate 160 to OR gate 162 during the first half of each firing cycle.

A race condition is now created in ignition system 150 between the output signal from conventional timing system 10 to one input terminal of OR gate 162 and the output signal from AND gate 160 of phase shifting network 152 to the other input terminal of OR gate 162. Specifically, above the predetermined engine rpm, the output signal from ignition system 10 will be supplied to OR gate 162 prior to the output signal from AND gate 160 (phase shifting network 152) such that firing in the engine is controlled thereby. However, below the predetermined engine rpm, the leading signal from phase shifting network 152, through phase shift circuit 154 will be supplied to the other input terminal of OR gate 162 prior to the presence of the ignition signal from ignition system 10 such that at lower engine rpm ignition timing is controlled by phase shifting network 152 of ignition system 150. Thus, the leading signal produced in the phase shifting portion of the circuit overrides timing of ignition system 10 to produce a minimum dwell angle for each speed below the predetermined engine rpm which ignition system 10 may increase but not decrease.

As an example, if it is assumed that the integrator circuits of ignition system 10 become saturated at an engine speed of approximately 750 rpm (20 millisecond firing cycle period) the excess dwell period shown as portion 74 of waveform F of FIG. 2, is approximately 2 milliseconds. The ramp time (the time that it takes to charge the ignition coil shown by waveform portion 69) can be assumed to be essentially constant and approximately 4 milliseconds in duration. Therefore, the total current conduction time through output amplifier stage 32 is approximately 6 milliseconds which is thirty percent of the total firing cycle. If, at 750 rpm and engine speeds thereabove, the lead angle of the phase shifted signal appearing at terminals B'—C is constant and occurs at a time during the firing cycle preceding the end of the instant firing cycle, time $T_5$, by approximately 30%, ignition system 10 controls firing in the engine. Thus, the output signal from ignition system 10 is produced at the input to OR gate 162 prior to the output signal from AND gate 160. For further explanation, referring to FIG. 2, the time interval $T_3$–$T_5$ at which current is initiated through amplifier stage 32 is approximately 30% (at 750 rpm) of the total firing cycle period, $T_0$–$T_5$. Thus, if the phase shifted signal B'—C occurs after time $T_3$, ignition system 10 controls ignition in the engine. However, at lower engine rpm, for example 150 rpm, the firing cycle period, $T_0$–$T_5$, is approximately 100 milliseconds in time duration. Therefore, with the assumption that the integrator circuits will be saturated at 750 rpm, the excess dwell period would be approximately 86 milliseconds in time duration (time period $T_4$–$T_5$) which, as discussed previously, could cause the output transistors in output amplifier stage 32 to dissipate more power than they are capable of dissipating. Therefore, disabling circuit 164, which may be, for example, a voltage level comparator and counting circuit known in the art, is provided to sense when the integrator circuits are in a saturated condition and to inhibit any output signal from the prior art ignition system for a predetermined number of cycles of engine operation, depending on the counting circuit employed. If, during the next firing cycle, the engine speed is still lower than the predetermined engine rpm, ignition system 10 will once again be inhibited by disabling circuit 164. This operation is repeated until such time that the engine speed increases and the integrator circuits of ignition system 10 operate within their dynamic range. Simultaneously, with ignition system 10 being inhibited, the lead in the phase shifted signal appearing at terminals B'—C which at the lower speeds precedes the end of the firing cycle period, time $T_5$for example, by 10% of the period, is supplied to OR gate 162 to render amplifier state 32 conductive at a predetermined and constant time before the next timing ignition signal is applied. In response to the next timing ignition signal an output signal is produced at the output of differential comparator 16 which inhibits AND gate 160, as previously discussed, and amplifier 32 is rendered nonconductive to discharge the ignition coil to provide the spark potential necessary to cause firing in the internal combustion engine. At mid-range engine speeds (180–600 rpm) phase shift circuit 154 produces a 7–8 msec lead to the applied timing signals which appear at terminals B'—C, which phase shifted signal provides sufficient excess dwell current to ensure firing in the engine. The phase shifting circuit continues to override ignition system 10 until such time that the engine rpm is increased beyond the predetermined speed as discussed above.

Figure 6:
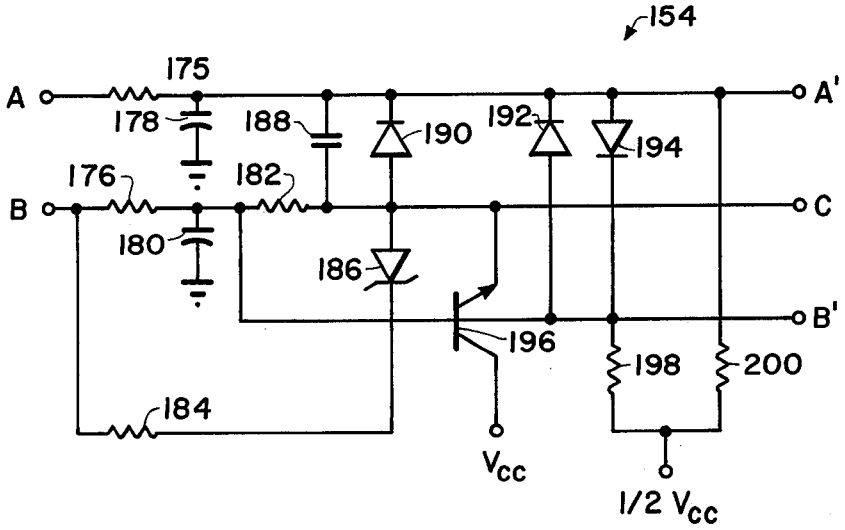
FIG. 6 is a schematic diagram of the phase shifting network comprising the embodiment of FIG. 5.

Referring to FIG. 6, there is shown phase shift circuit 154 suitable to be used in ignition system 150 of FIG. 5. The timing ignition signals supplied from the magnetic sensor to terminals A—B are applied to resistors 175 and 176 respectively. The other terminals of resistors 175 and 176 are coupled through respective capacitors 178 and 180 to a ground reference terminal of the ignition system. Terminal A' of ignition system 150 is directly connected at the junction between resistor 175 and capacitor 178 with output terminal B' of ignition system 150 being directly connected at the junction point between resistor 176 and capacitor 180. Thus there is no significant phase shift effected to the applied timing signal which appears across terminals A'—B'. The junction point between resistor 176 and capacitor 180 is coupled through resistor 182 to output terminal C of phase shift circuit 44. As shown in FIG. 5, output terminals A' and B' are connected to the inverting and noninverting terminals of comparator 14 of ignition system 10 with terminal B' being further connected to the noninverting input of differential comparator 158. Input terminal B of the ignition system is also coupled through resistor 184 to the cathode of diode 186 which has its anode connected to the other terminal of resistor 182 and output terminal C of the phase shift circuit. Connected between the anode of diode 186 and the junction point between resistor 175 and capacitor 178 is a parallel combination of capacitor 188 and diode 190, with the anode of diode 190 being connected to the anode of diode 186 and the cathode of diode 190 being connected to the junction between resistor 175 and capacitor 178. Diode 192 has its cathode electrode connected to output terminal A' and its anode connected to output terminal B'. Also coupled across output terminals A' and B' is diode 194. Transistor 196 has its emitter connected to output terminal C and its base connected to the junction of resistor 176 and capacitor 180, to output terminal B'. The collector of the transistor is coupled to a source of operating potential $V_{CC}$. Output terminal A' is also coupled through resistor 198 to a second source of operating potential which, for example, has a magnitude which is one-half of the operating potential $V_{CC}$. Terminal B' is also returned through resistor 200 to this second source of operating potential.

In operation, resistors 175, 176 and capacitors 178, 180 primarily function to filter very high frequency noise from the differential input timing ignition signal applied to terminals A—B of ignition system 150. At very low frequencies, (0–180 rpm), the signal amplitude is less than the forward voltages of diodes 186 and 190, and the differential voltage appearing between terminals B'—C leads the differential voltage between terminals B'—A' by 90°, producing, with respect to the applied ignition timing signal at input terminals A—B an approximate ten percent lead in phase to waveform A of FIG. 2. As the frequency and the amplitude of the input signal applied between terminals A and B increases, between 180 rpm to 600 rpm, diodes 186, 190 and 192 become forward biased at a predetermined time during the cycle. Due to the attenuation produced by the resistive combination of resistors 175, 176, 198 and 200, the differential output signal between terminals B'—A' is clamped as the input amplitude signal exceeds a magnitude of 2ϕ (2 diode voltage drops). Prior to this time, the differential input signal from the magnetic sensor which is applied between terminals A—B pumps the voltage across capacitor 188 down, such that a minimum voltage is produced thereacross through resistor 184 and diode 186 which increases the lead angle of the output signal between terminals B'—C over the output signal developed at terminals B'—A'. At very high frequencies, (engine rpm greater than 600 rpm) the output signal appearing at output terminals A'—C' is very rapidly pumped down through diode 186 and resistor 184 and is clamped at a voltage magnitude of −2ϕ diode 192 and transistor 196. Transistor 196 is used to prevent capacitive loading of the signal appearing across output terminals B' and A. The output signal appearing across output terminals B' and A. The output signal appearing across output terminal C and A' is increased, or pulled up to a predetermined level, by the zener current through diode 186. The combined effects of the large currents derived in resistor 184 and diode 186 and of the smaller currents derived through resistor 182, produce at high frequencies, a constant lead of the output signal appearing between terminals B'—C over the output signal appearing between output terminals B'—A'.

The circuit of FIG. 3 has been build with the following values:

| COMPONENTS | VALUE |
|---|---|
| Resistor 54 | 5600 ohm |
| Resistor 56 | 5600 ohms |
| Resistor 62 | 220,000 ohms |
| Resistor 64 | 10,000 ohms |
| Resistor 78 | 5600 ohms |
| Resistor 80 | 5600 ohms |
| Capacitor 58 | .02 microfarads |
| Capacitor 60 | .02 microfarads |
| Capacitor 68 | .25 microfarads |

The above described phase shifting circuit produced a phase lead at zero-crossing of the signal appearing between output terminals B'—C over the signal appearing between the output terminals B'—A' as follows:

| PHASE LEAD | ENGINE RPM |
|---|---|
| 10% | 15–180 rpm |
| 7–8 msec | 180–600 rpm |
| 30% | 600–6000 rpm |

In summary, there has been disclosed an ignition system comprising: first circuitry for directly operating on timing signals to produce spark potential for operating an internal combustion engine; and a phase shifting and disabling circuit for simultaneously producing a variable width pulse having a predetermined phase lead with respect to the applied timing signals. Above a predetermined engine speed the first circuitry provides the necessary spark potential and excess dwell time linearly regulated to be a fixed percentage of the firing cycle period. Below the predetermined engine rpm, the output from the first circuitry is inhibited by the disabling circuit and the variable width pulse is utilized for controlling firing in the engine. The variable width pulse produces a minimum dwell angle such that excess dwell current is reduced at low engine speeds. Therefore power consumption is reduced and better reliability is obtained by the ignition system of the invention.

What is claimed is:

1. A solid state ignition system for an internal combustion engine, which ignition system is responsive to successively applied alternating timing signals generated in timed relationship with the engine to charge and discharge an ignition coil to produce spark to operate the engine, comprising in combination:

first circuit means for varying the phase of the timing signals applied thereto by a predetermined amount which is a function of the engine rotational speed;

second circuit means responsive to the applied timing signals for processing the same to produce a first output signal, said second circuit means being operatively coupled to said first circuit means;

third circuit means responsive to said phase shifted timing signals for producing at an output terminal thereof a second output signal having a time duration which is dependent on said degree of phase shift effected to said phase shifted timing signals;

gating means responsive to either said first output signal or said second output signal for producing a control signal at an output thereof;

amplifier switching means responsive to said control signal from said gating means for conducting direct current through the coil to charge the same;

said first and second circuit means being responsive to the next one of the applied timing signals such that said first and second output signals are inhibited for a predetermined time to render said amplifier switching means nonconducting to discharge the ignition coil; and said second circuit means further including;

a. fourth circuit means adapted to receive each successive timing signal for producing a monopulse signal and a reference signal at respective outputs thereof, said monopulse signal being produced during a predetermined half cycle of each successive timing signal for a predetermined duration thereof, said reference signal having first and second portions, said first portion being indicative of said predetermined duration when said monopulse is being produced, said second portion being indicative of the remainder of the duration of each successive applied timing signals;

b. feedback means responsive to said direct current conducted through said amplifier switching means reaching a predetermined magnitude for producing a feedback control signal at an output thereof;

c. fifth circuit means operatively coupled to said first circuit means and said feedback means and being responsive to said monopulse signal and said feedback control signal for producing a variable threshold signal at an output thereof so that the excess dwell current through the coil is maintained a substantially fixed percentage of the time duration of the timing signals, the magnitude of said variable threshold signal being linearly related over a predetermined dynamic range to the time duration of each successive timing signal and the time duration for charging the ignition coil; and d. comparator-gating means responsive to said reference and said variable threshold signals applied thereto for producing said first output signal when the magnitude of said second portion of said reference signal reaches a predetermined value with respect to the magnitude of said variable threshold signals.

2. The ignition system of claim 1 wherein said fourth circuit means includes:

a first differential comparator circuit adapted to receive each successive applied timing signal at first and second inputs for producing a substantially square wave output pulse at an output thereof in response to each successive applied timing signal;

first integrator circuit means having an input terminal and an output terminal, said input terminal being coupled to said output of said first differential comparator means, said output terminal being coupled to said comparator-gating means and to said fifth circuit means, said first integrator circuit means being responsive to said square wave pulse train from sid first differential comparator means to provide said monopulse signal; and second integrator circuit means having an input and output terminal, said input terminal being connected to said output terminal of said first integrator circuit means and said output terminal being coupled to said comparator gating means, said second integrator circuit means being responsive to said monopulse signal from said first integrator circuit means for producing said reference signal at said output terminal thereof.

3. The ignition system of claim 3 wherein said comparator gating means includes:

second differential comparator means having first and second input terminals and an output terminal, said first input terminal being coupled to said second integrator circuit means, said second input terminal being coupled to said fifth circuit means;

additional gating means having a plurality of input terminals and an output terminal, a first one of said plurality of input terminals being coupled to the output of said first integrator circuit such that said first output signal is inhibited therefrom in response to said monopulse signal from said first integrator circuit, a second one of said plurality of input terminals being coupled to said feedback means; a third one of said plurality of input terminals being coupled to the output of said second differential comparator means said output terminal being connected to said gating means; and the magnitude of said first output signal appearing at the output of said additional gating means being varied in response to said feedback control signal such that said control signal from said gating means which is produced in response to said first output signal is varied to cause direct current limiting through said amplifier switching means.

4. The ignition system of claim 3 wherein said first circuit means includes a phase shift circuit adapted to receive the timing signals at first and second input terminals thereof and having a plurality of output terminals, the timing signals appearing across first and second output terminals of said plurality of output terminals in substantially undistorted form, said first and second output terminals being coupled to said first and second input terminals of said first differential comparator means, said phase shifted signal appearing across said second output terminal and a third output terminal, said second and third output terminals being connected to said third circuit means.

5. The ignition system of claim 4 wherein said phase shift circuit includes:

said first and second output terminals being coupled to said first and second input terminals;

resistive means coupled said third output terminal to said second input terminal;

capacitive means coupled between said first and third output terminals;

first electron control means having first and second electrodes, said first electrode being connected to said first output terminal and said second electrode being connected to said third output terminal;

second electron control means having first and second electrodes, said first electrode being coupled to said second input terminal, and said second electrode being connected to said third output terminal;

third electron control means having first and second electrodes, said first electrode being connected to said first output terminal and said second electrode being coupled to said second output terminal;

fourth electron control means having first and second electrodes, said first electrode being connected to said second output terminal, and said second electrode being connected to said first output terminal; and fifth electron control means having first, second and control electrodes, said first electrode being connected to said third output terminal, said second electrode being connected to a source of operating potential, and said control electrodes being coupled in series between said second input terminal and said second output terminal.

6. The ignition system of claim 5 wherein said third circuit means includes:

third differential comparator means having first and second input terminals and an output terminal, said first input terminal being connected to said second output terminal of said phase shift circuit, said second input terminal being coupled to said third output terminal of said phase shift circuit;

further gating means having first and second input terminals and an output terminal, said first input terminal being coupled to said output terminal of said third differential comparator means, said second input terminal being coupled to said first differential comparator means, said output terminal being coupled to a first input terminal of said gating means.

7. The ignition system of claim 6 further including disabling circuit means for temporarily inhibiting said first output signal from said second circuit means when the engine rotational speed is below a predetermined rpm.

8. The ignition system of claim 1 further including disabling circuit means for temporarily inhibiting said first output signal from said second circuit means when the rotational engine speed is below a predetermined rpm.

9. The ignition system of claim 3 wherein said third circuit means includes:

third differential comparator means having first and second input terminals and an output terminal, said first and second input terminals being adapted to receive said phase shifted signal from said first circuit means; and further gating means having first and second input terminals and an output terminal, said first input terminal being coupled to said output terminal from said third differential comparator means, said second input terminal being coupled to said output terminal from said first differential comparator means, and said output terminal being coupled to one of said input terminals of said gating means.

10. The ignition system of claim 1 wherein said first circuit means includes:

first and second input terminals adapted to receive the timing signals;

first and second output terminals coupled to said first and second input terminals and directly connected to said first circuit means;

first resistive means;

a third output terminal coupled through said first resistive means to said first input terminal of said second circuit means;

first electron control means having first and second electrodes, said second electrode being coupled to said third output terminal;

second resistive means coupled between said first input terminal and said first electrode of said first electron control means;

capacitive means coupled between said second and third output terminals;

second electron control means having first and second electrodes, said first electrode being coupled to said second output terminal, said second electrode being coupled to said third output terminal;

third electron control means having first and second electrodes, said first electrode being coupled to said second output terminal, said second electrode being coupled to said first output terminal;

fourth electron control means having first and second electrodes, said first electrode being coupled to said first output terminal, said second electrode being coupled to said second output terminal; and fifth electron control means having first, second and control electrodes, said first electrode being coupled to said third output terminal, said second electrode being coupled to a source of operating potential, said control electrodes being coupled in series between said first input terminal and said first output terminal.

11. In a solid state ignition system including circuitry for processing applied alternating timing signals which are generated in timed relationship with an internal combustion engine to produce a control signal and an amplifier switching circuit for alternately conducting and nonconducting to charge and discharge an ignition coil to produce spark for operating the engine, the improvement comprising:

circuit means responsive to each applied alternating timing signal for effecting a phase lead directly to the alternating timing signal by a predetermined amount which is a function of the engine rotational speed;

additional circuit means responsive to said phase shifted timing signal for producing an output signal the initiation thereof occurring prior to the end of the period of the generated timing signal by a time which is representative of said phase lead of said phase shifted timing signal;

circuit means for inhibiting the circuitry for processing applied timing signals below a predetermined engine rotational speed such that the control signal therefrom is inhibited; and gating means responsive to either the control signal from the circuitry for processing applied timing signals or said output signal from said additional circuit means for producing an output signal to render the amplifier switching circuit conducting and nonconducting.

12. The ignition system of claim 11 wherein said circuit means for varying the phase of the timing signal includes:

first and second input terminals and first, second and third output terminals said first output terminal being coupled to said first input terminal, said second output terminal being coupled to said second input terminal;

first resistive means coupled between said first input terminal and said third output terminal;

capacitive means coupled between said second output terminal and said third output terminal;

first electron control means having first and second electrodes, said first electrode being coupled to said second output terminal, said second electrode being coupled to said second output terminal, said second electrode being coupled to said third output terminal;

second electron control means having first and second electrodes, said second electrode being coupled to said said third output terminal;

second resistive means coupled between said first input terminal and said first electrode of said second electron control means;

third electron control means having first and second electrodes, said first electrode being coupled to said second output terminal, said second electrode being coupled to said first output terminal;

fourth electron control means having first and second electrodes, said first electrode being coupled to said first output terminal, said second electrode being coupled to said second output terminal; and fifth electron control means having first, second and control electrodes, said first electrode being coupled to said third output terminals, said second electrode being coupled to a source of operating potential, said control electrode being coupled in series between said first input terminal and said first output terminal.

13. The ignition system of claim 12 wherein said additional circuit means includes:

differential comparator means for producing a substantially square wave pulse in response to said phase shifted signal for said phase shift circuit, said differential comparator means having first and second input terminals connected to said first and third output terminals of said phase shift circuit and an output terminal; and additional gating means having first and second input terminals and an output terminal, said first input terminal being connected to said output terminal of said differential comparator means, said output terminal being coupled to the output of said circuit means for producing an output signal and said second input terminal being operatively coupled to said circuitry for processing applied alternating timing signals such that said output signal is positively inhibited for a predetermined time during the firing cycle of the engine.

14. A solid state ignition system for an internal combustion engine, which ignition system is responsive to successively applied alternating timing signals generated in timed relationship with the engine to charge and discharge an ignition coil to produce spark to operate the engine, comprising in combination;

a phase shift circuit having first and second input terminals adapted to receive the timing signals and a plurality of output terminals, said phase shift circuit including:

a. first and second output terminals of said plurality of output terminals being coupled to said first and second input terminals respectively;

b. first resistive means coupled between said first input terminal and a third output terminal of said plurality of output terminals;

c. capacitive means coupled between said second and third output terminals;

d. first electron control means having first and second electrodes, said first electrode being coupled to said second output terminal, said second electrode being coupled to said third output terminal;

e. second electron control means having first and second electrodes, said first electrode being coupled to said second output terminal, said second electrode being coupled to said first output terminal;

f. third electron control means having first and second electrodes, said first electrode being coupled to said first output terminal, said second electrode being coupled to said second output terminal;

g. fourth electron control means having first, second and control electrodes, said first electrode being coupled to said third output terminal, said second electrode being coupled to a source of operating potential, said control electrode being coupled in series between said first input terminal and said first output terminal;

h. fifth electron control means having first and second electrodes, said second electrode being coupled to said third output terminal; and i. second resistive means coupled between said first input terminal and said first electrode of said fifth electron control means;

first differential comparator means having first and second input terminals and on an output terminal, said first input terminal being coupled to said first output terminal of said phase shift circuit, said second input being coupled to said second output terminal of said phase shift circuit, said first differential comparator means being responsive to the timing signals applied thereto from said phase shift circuit for producing a substantially 50% duty cycle square wave pulse at said output terminal;

second differential comparator means having first and second input terminals and an output terminal, said first input terminal being coupled to said first output terminal of said phase shift circuit, said second input terminal being coupled to said third output terminal of said phase shift circuit, said second differential comparator means being responsive to the phase shifted timing signal applied to said first and second input terminals from said phase shift circuit for producing a substantially rectangular pulse at said output terminal, said rectangular pulse from said second differential comparator means having its phase shifted in respect to said 50% duty cycle square wave pulse from said first differential comparator means;

first gating means having first and second input terminals and an output terminal, said first input terminal being coupled to said output terminal of said second differential comparator means, said second input terminal being coupled through inverter means to said output terminal of said first differential comparator means, said first gating means producing a first output signal therefrom at a predetermined time during said timing signal;

first circuit means responsive to said square wave pulse from said first differential comparator means for producing a monopulse signal and a reference signal at respective outputs thereof, said monopulse signal being produced during a predetermined portion of each successive timing signal for a predetermined duration thereof, said reference signal having first and second portions, said first portion being indicative of said predetermined duration when said monopulse is being produced, said second portion being indicative of the remainder of the duration of each successive applied timing signal;

amplifier switching means responsive to a control signal applied thereto for conducting direct current through the ignition coil to charge the same, said amplifier switching means being rendered nonconductive when said control signal is inhibited such that the ignition coil is discharged to produce the spark to operate the engine;

feedback means responsive to said direct current conducted through said amplifier switching means reaching a predetermined magnitude for producing a feedback control signal at an output thereof;

second circuit means operatively coupled to said first circuit means and said feedback means and being responsive to said monopulse signal and said feedback control signal for producing a variable threshold signal at an output thereof, the magnitude of said variable threshold signal being linearly related over a predetermined dynamic range to the time duration of each successive timing signal and the time duration for charging the ignition coil;

comparator-gating means responsive to said reference signal and said variable threshold signal applied thereto for producing a second output signal therefrom when the magnitude of said second portion of said reference signal reaches a predetermined value with respect to the magnitude of said variable threshold signal;

second gating means having first and second input terminals and an output terminal for producing said control signal in response to either said first output signal from said first gating means or said second output signal from said comparator-gating means, said first input terminal being connected to said output terminal of said comparator-gating means, said second input terminal being coupled to said output from said first gating means, said output being coupled to said input of said amplifier switch means; and said comparator-gating means being responsive to said feedback control signal such that the magnitude of said output signal therefrom is varied with respect to the feedback control signal to limit said direct current conducted through said amplifier switch means to a maximum magnitude, said comparator-gating means also being responsive to said monopulse signals such that said control signal is inhibited during the time duration of said monopulse signal.

15. An ignition system for controlling the excess dwell time of the current through an ignition coil to control engine firing, the ignition system being responsive to timing signals which are generated in timed relationship with the engine during the firing cycle of the same comprising in combination:

first circuit means responsive to the timing signals for providing control signals to charge and discharge the coil including closed-loop feedback means for causing the excess dwell time to be a substantially fixed percentage of the firing cycle time when the engine speed is above a predetermined rpm;

second circuit means responsive to the timing signals for effecting a phase lead directly thereto by an amount which is a function of the engine speed to produce a variable width output signal for controlling the excess dwell time at engine speeds below said predetermined rpm the time that said variable width output signal is initiated during the firing cycle being a function of the phase shift effected to the timing signals; and circuit means for inhibiting said first circuit means to prevent said output signal from occurring therefrom when said engine speed is below said predetermined rpm.

16. The ignition system of claim 15 wherein said first circuit means includes;

third circuit means for producing a reference signal having a dual slope, the first slope thereof being representative of a first time period of the firing cycle and the second slope being representative of the remaining portion of the time period of the firing cycle;

fourth circuit means for producing a variable threshold signal having a magnitude which is proportional to the time duration of the preceding firing cycle;

comparator means responsive to said reference signal and said variable threshold signal for producing said control signals when the magnitude of the second slope of said reference signal reaches a predetermined value with respect to the magnitude of said variable threshold signal;

feedback means responsive to the current through the ignition coil reaching a predetermined magnitude for causing the same to be limited threreat and for causing the magnitude of the variable threshold signal to be varied; and output switching means responsive to said control signals from said comparator means or said variable width output signal from said second circuit means for charging and discharging the ignition coil.

17. The ignition system of claim 15 wherein said second circuit means includes:

first and second input terminals and first, second and third output terminals, said first output terminal being coupled to said first input terminal, said second output terminal being coupled to said second input terminal;

first resistive means coupled between said first input terminal and said third output terminal;

capacitive means coupled between said second output terminal and said third output terminal;

first electron control means having first and second electrodes, said first electrode being coupled to said second output terminal, said second electrode being coupled to said third output terminal;

second electron control means having first and second electrons, said second electrode being coupled to said third output terminal;

second resistive means coupled between said first input terminal and said first electrode of said second electron control means;

third electron control means having first and second electrodes, said first electrode being coupled to second output terminal, said second selectrode being coupled to said first output terminal;

fourth electron control means having first and second electrodes, said first electrode being coupled to said first output terminal, said second electrode being coupled to said second output terminal; and fifth electron control means having first, second and control electrodes, said first electrode being coupled to said third output terminal, said second electrode being coupled to a source of operating potential, said control electrode being coupled in series between said first input terminal and said first output terminal.

18. The ignition system of claim 17 further including:

differential comparator means for producing substantially square wave output pulse in response to said phase shifted timing signal, said differential comparator means having first and second input terminals connected to said first and third output terminals of said second circuit means, and an output terminal; and gating means for producing said variable width output signal, said gating means having a first input terminal connected to said differential comparator means and a second input terminal connected to said first circuit means, and an output terminal, said output terminal being coupled to said output switching means.

* * * * *